US007704297B2

(12) United States Patent
Akimoto et al.

(10) Patent No.: US 7,704,297 B2
(45) Date of Patent: Apr. 27, 2010

(54) NICKEL POWDER MANUFACTURING METHOD

(75) Inventors: Yuji Akimoto, Fukuoka (JP); Kazuro Nagashima, Ohnojo (JP); Hidenori Ieda, Dazaifu (JP); Tetsuya Kimura, Fukuoka (JP)

(73) Assignee: Shoei Chemical Inc., Tokyo (JP)

( * ) Notice: Subject to any disclaimer, the term of this patent is extended or adjusted under 35 U.S.C. 154(b) by 315 days.

(21) Appl. No.: 11/732,239

(22) Filed: Apr. 3, 2007

(65) Prior Publication Data

US 2007/0251351 A1 Nov. 1, 2007

(30) Foreign Application Priority Data

Apr. 27, 2006 (JP) ..... 2006-122784
Feb. 27, 2007 (JP) ..... 2007-046373

(51) Int. Cl.
*B22F 9/24* (2006.01)

(52) U.S. Cl. ..... 75/348; 75/351; 75/369; 75/374

(58) Field of Classification Search ..... None
See application file for complete search history.

(56) References Cited

U.S. PATENT DOCUMENTS 5,871,840 A 2/1999 Asada et al.
5,928,405 A * 7/1999 Ranade et al. ..... 75/337
6,060,165 A 5/2000 Asada et al.
6,316,100 B1 11/2001 Kodas et al.
6,530,972 B2 * 3/2003 Akimoto et al. ..... 75/351
2002/0114950 A1 8/2002 Akimoto et al.

FOREIGN PATENT DOCUMENTS

| | | |
|---|---|---|
| JP | 62-001807 | 1/1987 |
| JP | 04-365806 | 12/1992 |
| JP | 2002-020809 | 1/2002 |
| JP | 2004-099992 | 4/2004 |
| TW | 429180 | 4/2001 |

* cited by examiner

*Primary Examiner*—George Wyszomierski
(74) *Attorney, Agent, or Firm*—Flynn, Thiel, Boutell & Tanis, P.C.

(57) ABSTRACT

A melt of nickel nitrate hydrate is introduced as droplets or liquid flow into a heated reaction vessel and thermally decomposed in a gas phase at a temperature of 1200° C. or more and at an oxygen partial pressure equal to or below the equilibrium oxygen pressure of nickel-nickel oxide at that temperature to manufacture a highly crystalline fine nickel powder with an extremely narrow particle size distribution. The oxygen partial pressure during the thermal decomposition is preferably $10^{-2}$ Pa or less, and a metal other than nickel, a semimetal and/or a compound of these may be added to the nickel nitrate hydrate melt to manufacture a highly crystalline nickel alloy powder or highly crystalline nickel composite powder. The resultant powder is suited in particular to thick film pastes such as conductor pastes for manufacturing ceramic multilayer electronic components.

5 Claims, 1 Drawing Sheet

NICKEL POWDER MANUFACTURING METHOD

BACKGROUND OF THE INVENTION

1. Field of the Invention

The present invention relates to a method for manufacturing a metal powder suitable for use in electronic components and the like, and relates more particularly to a method for manufacturing a fine, highly crystalline nickel powder of a uniform particle size which is useful as a conductive powder for the conductor pastes used in electronics components.

2. Description of the Related Art

The conductive metal powders used in conductor pastes for forming electronic circuits are desired to be fine powders having few impurities and an average particle size of about 0.01 to 10 μm, and to be composed of monodispersed particles of a uniform size and shape without aggregation. They also need to have good dispersibility in paste, and to have good crystallinity so as not to cause nonuniform sintering.

In particular, when used to form an internal conductor or external conductor in a multilayer capacitor, multilayer inductor or other multilayer ceramic electronic components, a powder needs to have a fine particle size as well as a uniform particle size and shape so that the conductor can be formed as a thin film, and in addition it needs to have a high sintering initiation temperature and be resistant to expansion and contraction caused by oxidation and reduction during sintering so as to prevent delamination, cracks and other structural defects. Consequently, there is demand for submicron-sized nickel powders that are spherical, of low reactivity and highly crystalline.

Conventional methods of manufacturing such highly crystalline nickel powders include a vapor phase chemical reduction method in which nickel chloride vapor is reduced with a reducing gas at a high temperature (see for example Japanese Patent Publication No. 4-365806A), and a spray pyrolysis method in which a solution or suspension of a metal compound dissolved or suspended in water or an organic solvent is formed into fine droplets, and these droplets are heated and thermally decomposed at a high temperature preferably near or above the melting point of the metal to thereby precipitate a metal powder (see for example Japanese Patent Publication No. 62-1807A). A method is also known of thermally decomposing a solid metal compound powder that has been dispersed at a low concentration in a gas phase (see for example Japanese Patent Publication Nos. 2002-20809A & 2004-99992A). In this method, a powder of a thermally decomposable metal compound is supplied using a carrier gas to a reaction vessel where it is dispersed at a low concentration in a gas phase, and then heated at a temperature higher than the decomposition temperature and at or above a temperature (Tm −200° C.) 200° C. lower than the melting point (Tm) of the metal to produce a highly crystalline metal powder.

However, because nickel chloride is normally used as the nickel compound in the vapor phase chemical reduction method because of its high vapor pressure, the resulting metal nickel powder contains residual chlorine. The chlorine needs to be removed by washing because it can adversely affect the properties of electronic components, but washing is likely to cause aggregation, and separation may require long periods of time or complex processes. Moreover, the composition cannot be accurately controlled when preparing an alloy of metals with different vapor pressures.

With the spray pyrolysis method, on the other hand, highly crystalline or single-crystal metal powders and alloy powders which have a high purity, a high density and a high dispersibility can be obtained. However, because this method uses large quantities of solvent the energy loss during thermal decomposition is extremely high, and aggregation and splitting of the droplets also cause the resulting powder to have a broad particle size distribution, making it difficult to set the reaction conditions such as droplet size, spray rate, droplet concentration in the carrier gas and retention time in the reaction vessel so as to obtain a powder with a uniform particle size, and leading to increased costs because the dispersion concentration of the droplets cannot be increased. Because evaporation of the solvent occurs from the surfaces of the droplets, moreover, they are likely to become hollow or split when the heating temperature is low.

In comparison with the spray pyrolysis method, the method of thermally decomposing a solid metal compound powder in a gas phase offers the advantages, for example, of no energy loss due to evaporation of the solvent, high efficiency because the raw material powder is not prone to aggregation and splitting and can be dispersed at a relatively high concentration in the gas phase, and the fact that a solid powder with good crystallinity can be obtained even at a relatively low temperatures. However, further increasing the dispersibility requires more energy or special dispersion equipment to increase the ejection speed into the reaction vessel for example, and the raw material powder must be even finer when manufacturing an extremely fine metal powder, making particle size adjustment and dispersion difficult. Moreover, when cheap, easily available cost nickel nitrate powder or nickel nitrate hydrate powder is used as the raw material, because these compounds are extremely hygroscopic the particles tend to stick together, and also tend to adhere to and block the disperser and nozzle, making the powder itself difficult to deliver to the reaction vessel in a dispersed state.

SUMMARY OF THE INVENTION

It is an object of the present invention to resolve the aforementioned problems of prior art and to provide a method whereby a fine, spherical, highly crystalline nickel powder suited in particular to thick film pastes such as conductor pastes for manufacturing ceramic multilayer electronic components for example and having high purity, density and dispersibility with an extremely narrow particle size distribution can be obtained efficiently and at low cost. In particular, it is an object to provide a method whereby such a powder can be easily manufactured with easy preparation of raw materials and without the need for strict control over the raw material particle size, dispersal conditions or reaction conditions. Accordingly, the present invention is constituted of the following aspects.

(1) A method for manufacturing a highly crystalline nickel powder, wherein a melt of nickel nitrate hydrate is introduced into a heated reaction vessel as liquid droplets or liquid flow and thermally decomposed in a gas phase at a temperature of 1200° C. or more and at an oxygen partial pressure equal to or below the equilibrium oxygen partial pressure of nickel-nickel oxide at that temperature.

(2) The method for manufacturing a highly crystalline nickel powder according to (1) above, wherein the oxygen partial pressure is $10^{-2}$ Pa or less.

(3) The method for manufacturing a highly crystalline nickel powder according to (1) or (2) above, wherein a reducing agent is added to the melt of nickel nitrate hydrate.

(4) A method for manufacturing a highly crystalline nickel alloy powder or highly crystalline nickel composite powder, wherein a melt of nickel nitrate hydrate having added thereto at least one of metals other than nickel, semimetals and compounds thereof is introduced into a heated reaction vessel as liquid droplets or liquid flow, and thermally decomposed in a gas phase at a temperature of 1200° C. or more and at an oxygen partial pressure of $10^{-2}$ Pa or less.

(5) The method for manufacturing a highly crystalline nickel alloy powder or highly crystalline nickel composite powder according to (4) above, wherein a reducing agent is further added to the melt of nickel nitrate hydrate.

With the present invention, it is possible to manufacture a fine nickel particle with an average particle size of about 0.1 to 2.0 μm by an extremely easy process using cheap, easily available nickel nitrate hydrate as the raw material by utilizing the unique decomposition behavior of this material.

In the present invention, a monodispersed powder with a uniform particle size is obtained easily without the need to dissolve the raw materials in a solvent, control the droplet size within a fixed range or precisely adjust the particle size of the raw material powder. Since the dispersal conditions in the gas phase and the reaction conditions also do not need to be controlled precisely, there is no need for specialized equipment or strict process control. It is also not absolutely necessary to use a carrier gas to highly disperse the raw materials in the gas phase. This allows for low-cost and efficient mass production.

The resulting nickel powder consists of spherical particles of a fine and extremely uniform particle size, and is a highly pure and dense monodispersed powder without aggregation. It is also extremely crystalline, with very few defects or grain boundaries within the particles. It therefore has a high sintering initiation temperature despite being a fine powder, and is also oxidation resistant. It is consequently suited to thick-film pastes in particular, and when it is used in conductor pastes for manufacturing the internal conductors and external conductors of ceramic multilayer electronic components for example it is possible to suppress the occurrence of delamination, cracks and other structural defects stemming from oxidation and reduction during firing or non-conformance with the sintering shrinkage behavior of the ceramic layer, and to manufacture components having excellent properties with good yield. A spherical, highly crystalline nickel alloy powder or nickel composite powder which is fine, highly dispersible and of a uniform particle size can also be obtained by adding at least one of the metals other than nickel, semimetals and compounds of these to the raw material melt.

DETAILED DESCRIPTION OF THE PREFERRED EMBODIMENTS

Figure 1:
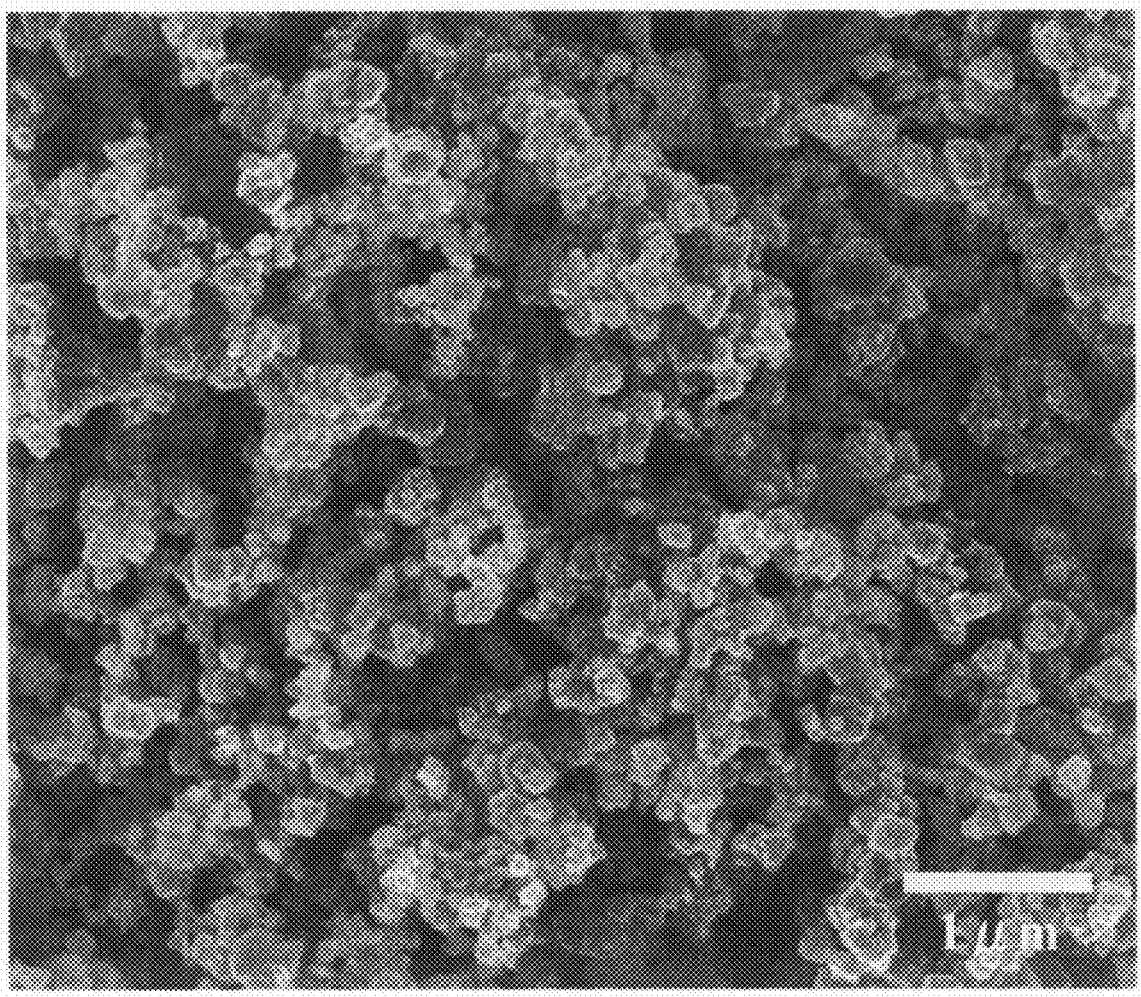
FIG. 1 is a scanning electron microscope image of nickel oxide particles produced when the nickel nitrate hydrate melt used in the manufacturing method of the present invention was heated to 500 to 600° C.

The present invention features the use of a melt of nickel nitrate hydrate as the raw material. Nickel nitrate, which is free from crystal water, and aqueous nickel nitrate solution decompose when heated at 100° C. or more, but for example the crystals of nickel nitrate hexahydrate have a melting point around 57° C., and melt before decomposition when heated, forming a melt. When this melt is further heated it has the property of forming particles of nickel oxide at 500 to 600° C. When the resulting particles of nickel oxide are observed by SEM or the like, they appear as fine primary particles with a uniform particle size of about 0.1 to 0.2 μm loosely aggregated to form large aggregate particles as shown in FIG. 1. The research of the present inventors have shown that when obtained by heating a melt of nickel nitrate hydrate, such primary particles of nickel oxide are always about 0.1 to 0.2 μm in particle size regardless of the condition of the raw material, the heating method, the heating rate and other process conditions. Moreover, the aggregated particles of nickel oxide can be deflocculated with little effort to easily obtain submicron-sized fine particles. Of the generally available nickel compounds, only nickel nitrate hydrate was confirmed to have such a property.

The present invention utilizes this property of nickel nitrate hydrate. That is, a melt of nickel nitrate hydrate is heated and delivered to a reaction vessel as liquid droplets or liquid flow, and thermally decomposed in a gas phase at 1200° C. or more under conditions such as to produce nickel metal, and it is believed that as the melt heats up within the reaction vessel aggregated fine primary particles of nickel oxide as discussed above are produced at 500 to 600° C., and naturally break down into particles in a dispersed state in the gas phase inside the reaction vessel, after which the nickel oxide is reduced by further exposure to high temperatures, resulting in a nickel powder. In particular, when the nickel nitrate hydrate melt is introduced into a reaction vessel heated to a high temperature of at least 1200° C., it is rapidly heated and decomposed, producing large quantities of nickel oxide crystal nuclei and leading to the formation of aggregated particles composed of fine primary particles, and because the gas produced by decomposition of the nickel nitrate hydrate acts to prevent material transfer between the primary particles, the aggregate particles of primary particles easily break apart into fine particles of nickel oxide, with very little fusion or particle growth. Reduction then occurs during high temperature heating at 1200° C. or higher with the same dispersion state maintained in a gas phase, producing a highly dispersible fine nickel metal powder. Consequently, the raw material concentration in the gas phase can be higher than in the conventional spray pyrolysis method or thermal decomposition of metal compound powder in a gas phase, and the dispersion conditions and reaction conditions do not need to be strictly controlled.

The present invention is explained in more detail below.

[Nickel Nitrate Hydrate Melt]

The most easily available nickel nitrate hydrate is nickel nitrate hexahydrate. The nickel nitrate hydrate can be made into a melt by heating it to a temperature at or above its melting point. In the case of nickel nitrate hexahydrate alone, it can be in the state of melt between about 60° C. and 160° C. without decomposition, but a melt at about 70 to 90° C. is preferred from the standpoint of storage stability.

However, because using such a high-temperature melt present difficulties in handling and designing the associated manufacturing equipment, it is desirable to lower the temperature of the melt by adding a compound capable of lowering the melting point of nickel nitrate hydrate. Examples of such compounds include inorganic salts that are compatible with the nickel nitrate hydrate melt and lower its melting point, such as ammonium nitrate and nitrate salts of various metals. When ammonium nitrate is added for example, the melting temperature can be lowered to about room temperature, improving operability. The added amount of this inorganic salt is preferable 1 to 5 moles per 1 mole of nickel.

A reducing agent such as lactic acid, citric acid, ethylene glycol or the like can also be added in order to stabilize the melt and ensure reduction of the nickel oxide particles produced as an intermediate. The added amount of these reducing agents is preferably about 0.2 to 2 moles per 1 mole of nickel.

In the present invention, by adding at least one of metals, semimetals and compounds of these that form alloys or solid solutions with nickel and/or at least one of metals, semimetals and compounds that do not form solid solutions with nickel under the reaction conditions, it is possible to easily manufacture an alloy powder or composite powder having nickel and these metals and/or semimetals as constituent elements.

The metals and semimetals that form alloys or solid solutions with nickel are not particularly limited, but copper, cobalt, gold, silver, platinum group metals, rhenium, tungsten, molybdenum and the like can be used when forming the conductor layers of multilayer electronic components for example.

There are no particular limits on the materials for forming a composite powder of nickel, but examples include high-melting-point metals, metal oxides, metal double oxides, semimetal oxides, glass-forming metal oxides and others that do not form solid solutions with nickel under the heating conditions. The form of the composite powder is not particularly limited, and depending on the used materials and quantities thereof and the heat treatment temperature and the like, it is possible to produce a composite powder in which these materials coat or adhere to the surfaces of the nickel particles, a composite powder in which nickel coats or adheres to the surfaces of particles consisting of these materials, or a composite powder in which these materials are dispersed within the nickel particles. For example, if barium nitrate and titanyl lactate are added and heated to a temperature at or above the melting point of nickel, a nickel composite powder is obtained having barium titanate crystals coating or adhering to the surfaces of the nickel particles.

The raw materials for the metals and semimetals other than nickel making up these alloy powders or composite powders may be any that can be melted in nickel nitrate hydrate in a molten state or uniformly dispersed in nickel nitrate hydrate in a molten state, and examples include nitrates, lactates, fine oxide and metal powders and the like. The added amount thereof is not particularly limited but must be such as to not detract from the unique properties of the nickel nitrate hydrate discussed above.

[Supply of Melt to Reaction Vessel and Thermal Decomposition]

The following explanation pertains to pure nickel powder, but roughly the same holds true for the aforementioned alloy powders and composite powders, and the term "nickel powder" below encompasses such alloy powders and composite powders.

In the conventional spray pyrolysis method, the size of the droplets atomized in the reaction vessel is extremely important, and, for example, an ultrasonic atomizer is used by preference to continuously generate fine droplets of a uniform size. In the present invention, however, the size of the droplets of melt does not directly affect the particle size of the resulting powder due to the use of the aforementioned properties of nickel nitrate hydrate. Consequently, the droplet size does not need to be strictly controlled. Therefore, besides droplets produced by an ultrasonic atomizer, relatively large droplets produced by an ordinary single-fluid atomizer, two-fluid atomizer or the like can be used. Moreover, a similar powder can be produced by means of a melt supplied as is as a fine tubular flow or shower. However, if the size of the droplets or liquid flow is too large the reaction will be delayed, making it necessary to extend the retention time (heating time) in the reaction vessel, which detracts from efficiency. A single-fluid atomizer or two-fluid atomizer is therefore used by preference.

The reaction vessel is not particularly limited as long as it has a high-temperature heating means and an associated mechanism for expelling the powder outside the reaction zone by means of a gas flow or gravity. Using a tubular reaction vessel heated by an electric furnace for example, the raw material melt and a carrier gas at a fixed flow speed can be supplied to the reaction vessel from an opening at one end, and the resulting metal powder can be collected from an opening at the other end. Alternatively, the raw material melt can be atomized as a shower from an opening at the top of a heated vertical tubular reaction vessel, and the resulting metal powder can be collected from another opening at the bottom of the tube. Heating can be accomplished from outside the reaction vessel by means of an electric furnace or gas furnace, but it is also possible to use a combustion flame of fuel gas supplied to the reaction vessel.

A heating temperature of 1200° C. or more is used in the present invention to thermally decompose the melt of nickel nitrate hydrate into nickel oxide and then reduce this into highly crystalline nickel powder. Because the reduction reaction of the nickel oxide is a solid phase reaction, crystal growth is accelerated in a short period of time, resulting in a highly crystalline nickel powder with few internal defects and no aggregation. If the heating temperature is below 1200° C., a highly crystalline metal powder will not be obtained. The heating time is not particularly limited as long as it is sufficient to cause the aforementioned reaction and crystal growth, and can be set appropriately depending on the equipment and the like, but normally the retention time in the reaction vessel is about 0.3 to 30 seconds.

In particular, heat treatment should be at a high temperature near or above the melting point of the nickel or nickel alloy, such as about 1450 to 1800° C., in order to obtain a smooth-surfaced, truly-spherical single-crystal metal powder. However, it is easy to obtain a spherical powder even at a heating temperature below the melting point because the nickel oxide particles produced as an intermediate are both fine and solid (not hollow particles). Moreover, although the initial process in the method of the present invention is a liquid phase reaction using droplets of a nickel nitrate hydrate melt, no solvent is used unlike in the spray pyrolysis method, so hollowing and splitting do not occur even at low heating temperatures, resulting in a dense and solid nickel powder. Consequently, heating at or above the melting point is not absolutely necessary. There is no particular upper limit on the heating temperature, which may be any temperature at which the nickel does not vaporize, but high temperatures above 1800° C. offer no particular advantages and only increase production costs.

The atmosphere during heating is an atmosphere in which nickel oxide is reduced to produce nickel metal. Specifically, the oxygen partial pressure of the atmosphere can be equal to or below the equilibrium oxygen partial pressure of nickel-nickel oxide at that temperature so as to produce nickel metal by reduction of nickel oxide, and since heating is performed at 1200° C. or more in the present invention as discussed above, the oxygen partial pressure is preferably $10^{-2}$ Pa or less. More preferably $10^{-7}$ Pa or less, still preferably $10^{-12}$ Pa or less is desirable as the oxygen partial pressure for purposes of promoting the reduction reaction of the nickel oxide and reliably and stably producing a nickel powder with little oxidation. To this end an inert gas such as nitrogen or argon is used as the carrier gas or atmospheric gas in the reaction vessel, but in order to obtain a weakly reducing atmosphere and prevent oxidation of the resulting nickel powder, a reducing gas such as hydrogen, carbon monoxide, methane or ammonia gas or an organic compound such as an alcohol or carboxylic acid that decomposes during heating to create a reducing atmosphere may also be included.

Strictly speaking, the oxygen partial pressure for producing an alloy powder or composite powder differs depending on the target composition of the nickel alloy powder or nickel composite powder in the present invention, but a nickel alloy powder or composite powder of a composition commonly used in electronics components can be produced at an oxygen partial pressure of $10^{-2}$ Pa or less, preferably $10^{-7}$ Pa or less, and more preferably $10^{-12}$ Pa or less.

One or more elements of silicon, sulfur, phosphorus, etc. can also be included in the atmospheric gas or carrier gas in order to reduce the surface activity of the nickel powder. These elements can reduce the catalytic activity of the nickel powder by acting on the nickel powder surfaces. The source of the elements such as silicon, sulfur, phosphorus, etc., may be substances including these elements or the compounds of these elements that are existent as vapor or can be vaporized in the system and specifically there may be mentioned silanes, silicic acid esters, elemental sulfur, hydrogen sulfide, sulfur oxides, thiols, mercaptans, thiophenes, phosphorus oxides, etc.

In conventional methods of spray pyrolysis or thermal decomposition of compound powders, the droplets or raw material particles must be highly dispersed in the gas phase so that the resulting powder does not become too coarse due to collisions between the droplets or raw material particles in the heating step, and this means that large quantities of carrier gas must be used or the carrier gas must be expelled at high speeds. In the present invention, however, because the nickel oxide particles produced as an intermediate naturally disaggregate when dispersed in the gas phase as discussed above, the particle size of the resulting powder does not inherently depend on the quantity or flow speed of the gas used to deliver and disperse the nickel nitrate hydrate melt in the reaction vessel. Consequently, a carrier gas can be used only as necessary, and when used the quantity and flow speed can be determined appropriately depending on the shape of the reaction vessel, the type of equipment used to supply the raw material melt, the supply rate of the raw material melt and the like. For example, in Example 4 (discussed below) a carrier gas is not required because the melt of nickel nitrate hydrate is formed into droplets with a single-fluid atomizing nozzle and delivered to the reaction vessel by gravity. In Example 1, the melt is formed into droplets with a two-fluid atomizing nozzle, and supplied to the reaction vessel using a reducing gas supplied as the carrier to the atomizer. However, the amount of carrier gas should be as small as possible in order to improve production efficiency.

Next, the present invention is explained in detail using examples, but the present invention is not limited by these examples. In the examples below, a high-pressure single-fluid atomizing nozzle "MeeFog" No. FM-50-B270 made by Mee Industries was used as the single-fluid atomizing nozzle, and a two-fluid atomizing nozzle "Fine Mist Nozzle BIM Series" No. 20075S303 made by Kabushiki Kaisha Ikeuchi was used as the two-fluid atomizing nozzle.

EXAMPLE 1

Nickel nitrate hexahydrate powder was melted by being heated to about 80° C. This melt was formed into droplets with the two-fluid atomizing nozzle, using 300 L/min of forming gas (nitrogen gas containing 3% hydrogen) as the carrier gas, and supplied at a rate of 1 kg/hr in an electrical furnace heated to 1600° C. The oxygen partial pressure inside the furnace was between $10^{-7}$ and $10^{-8}$ Pa. The resulting powder was captured in a bag filter. When this powder was analyzed by X-ray diffractometry (XRD), transmission electron microscopy (TEM) and scanning electron microscopy (SEM), although some slight oxidation was observed, it was found to consist of substantially single-crystal particles of nickel metal. Under SEM observation, the particles were truly spherical in shape, with a particle size of 0.1 to 1.5 μm, a mean particle size of 0.32 μm and no aggregation.

EXAMPLE 2

Nickel nitrate hexahydrate powder was melted by being heated to about 80° C. This melt was formed into droplets with the two-fluid atomizing nozzle, using 300 L/min of forming gas (nitrogen gas containing 4% hydrogen) as the carrier gas, and supplied at a rate of 1 kg/hr in an electrical furnace heated to 1600° C. The oxygen partial pressure inside the furnace was $10^{-12}$ Pa or less. The resulting powder was captured in a bag filter. This powder was found to be a substantially single-crystal nickel powder consisting of truly spherical particles with a particle size of 0.1 to 1.5 μm (mean particle size 0.30 μm), without aggregation.

EXAMPLE 3

Ammonium nitrate was added to nickel nitrate hexahydrate powder in the amount of 1.5 moles per 1 mole of nickel, and the mixture was melted by being heated to 60° C. and cooled to room temperature to obtain a nickel nitrate hexahydrate melt containing ammonium nitrate. A nickel powder was obtained as in Example 2 except that the melt was supplied to the two-fluid atomizing nozzle while still at room temperature. When the resulting powder was analyzed as before, it was found to be a nickel powder consisting of substantially single-crystal truly-spherical particles with a particle size of 0.1 to 1.5 μm (mean particle size 0.30 μm), without aggregation.

EXAMPLE 4

Lactic acid as a reducing agent was added to nickel nitrate hexahydrate powder in the amount of 1.2 moles per 1 mole of nickel, and the mixture was melted by being heated to 60° C. This melt was supplied as droplets at a rate of 10 kg/hr from the high-pressure single-fluid atomizing nozzle installed at the top of an electrical furnace heated to 1550° C. Nitrogen gas was passed through the electrical furnace simultaneously at 10 L/min. The oxygen partial pressure inside the furnace was $10^{-12}$ Pa or less due to decomposition of the lactic acid in the melt. The resulting powder was captured in a bag filter. This powder was found to be a substantially single-crystal nickel powder consisting of truly spherical particles with a particle size of 0.1 to 1.5 μm (mean particle size 0.30 μm), and no aggregation.

EXAMPLE 5

Nickel nitrate hexahydrate powder and copper nitrate trihydrate powder were mixed at a mole ratio of nickel:copper=60:40, 1.2 moles of lactic acid was then added per 1 mole of total nickel and copper, and the mixture was melted by being heated to 70° C. This melt was supplied as droplets at a rate of 10 kg/hr from the high-pressure single-fluid atomizing nozzle installed at the top of an electrical furnace heated to 1400° C. Nitrogen gas was also passed simultaneously through the electrical furnace at 10 L/min. The oxygen partial pressure inside the furnace was $10^{-12}$ Pa or less due to decomposition of the lactic acid in the melt. The resulting powder was captured in a bag filter. When the resulting powder was analyzed by XRD, TEM and SEM, it was found to be a nickel/copper alloy powder consisting of substantially single-crystal truly-spherical particles with a particle size of 0.1 to 2.0 μm (a mean particle size of 0.35 μm) and no aggregation. A close inspection of the XRD data revealed no nickel or copper peak, only an alloy phase of roughly 60/40 nickel/copper.

EXAMPLE 6

Barium nitrate and titanyl lactate were mixed with nickel nitrate hexahydrate powder at a mole ratio of nickel:barium:titanium=1:0.01:0.01, 1.2 moles of lactic acid per 1 mole of nickel was further added as a reducing agent, and the mixture was melted by being heated to 70° C. This melt was supplied as droplets at a rate of 10 kg/hr from the high-pressure single-fluid atomizing nozzle installed at the top of an electrical furnace heated to 1550° C. Nitrogen gas was also passed through the furnace at the same time at a rate of 10 L/min. The oxygen partial pressure inside the furnace was $10^{-12}$ Pa or less due to decomposition of the lactic acid in the melt. The resulting powder was captured in a bag filter. When the resulting powder was analyzed by XRD, TEM and SEM, it was found to be a barium titanate-coated nickel composite powder consisting of substantially single-crystal truly-spherical nickel metal particles having crystals of barium titanate precipitated not uniformly but roughly over the entire surface of the particles, with a particle size distribution in the range of 0.1 to 1.5 μm (mean 0.30 μm) and no aggregation.

COMPARATIVE EXAMPLE 1

Nickel powder was manufactured as in Example 4 except that the temperature of the electrical furnace was 1100° C. The resulting powder was amorphous with a broad particle size distribution, consisting of aggregation of fine crystals with low crystallinity.

What is claimed is:

1. A method for manufacturing a highly crystalline nickel powder, comprising the steps of introducing a melt of nickel nitrate hydrate free from a solvent into a heated reaction vessel as liquid droplets or as liquid flow and thermally decomposing the nickel nitrate hydrate in a gas phase at a temperature of 1200° C. or more and at an oxygen partial pressure equal to or below the equilibrium oxygen partial pressure of nickel-nickel oxide at that temperature to form the highly crystalline nickel powder.

2. The method for manufacturing a highly crystalline nickel powder according to claim 1, wherein said oxygen partial pressure is $10^{-2}$ Pa or less.

3. The method for manufacturing a highly crystalline nickel powder according to claim 1, wherein a reducing agent is added to said melt of nickel nitrate hydrate.

4. A method for manufacturing a highly crystalline nickel alloy powder or highly crystalline nickel composite powder, comprising the steps of introducing a melt of nickel nitrate hydrate free from a solvent and having added thereto at least one of a metal other than nickel, a semimetal, and a compound thereof into a heated reaction vessel as liquid droplets or liquid flow, and thermally decomposing the nickel nitrate hydrate in a gas phase at a temperature of 1200° C. or more and at an oxygen partial pressure of $10^{-2}$ Pa or less, to form highly crystalline nickel powder.

5. The method for manufacturing a highly crystalline nickel alloy powder or highly crystalline nickel composite powder according to claim 4, wherein a reducing agent is further added to said melt of nickel nitrate hydrate.

* * * * *